US005266240A

United States Patent [19]

Valenzuela et al.

[11] Patent Number: 5,266,240

[45] Date of Patent: Nov. 30, 1993

[54] FLOTATION REACTOR WITH EXTERNAL BUBBLE GENERATOR

[75] Inventors: Ulises M. Valenzuela; Guillermo R. Moguel, both of Col. Los Morales Polanco, Mexico

[73] Assignee: Servicios Corporativos Frisco, S.A. de C.V., Mexico City, Mexico

[21] Appl. No.: 918,730

[22] Filed: Sep. 17, 1992

Related U.S. Application Data

[62] Division of Ser. No. 672,499, Mar. 20, 1991.

[51] Int. Cl.[5] ..... B03D 1/16; B01F 5/04

[52] U.S. Cl. ..... 261/93; 261/122.1; 209/169

[58] Field of Search ..... 209/169, 170; 210/221.2; 261/122.1, 93

[56] References Cited

U.S. PATENT DOCUMENTS

| | | | |
|---|---|---|---|
| 1,124,856 | 1/1915 | Callow | 209/170 |
| 1,326,174 | 12/1919 | Borcherdt | 209/170 |
| 1,329,335 | 1/1920 | Callow | 209/170 |
| 1,471,332 | 10/1923 | Greenwalt | 209/169 |
| 1,910,386 | 5/1933 | Garrett | 209/170 |
| 1,952,727 | 3/1934 | Ralston | 209/170 |
| 2,061,564 | 11/1936 | Drake et al. | 261/93 |
| 2,182,442 | 12/1939 | Booth | 209/169 |
| 2,369,401 | 2/1945 | Morash | 209/169 |
| 2,756,877 | 7/1956 | Sayers | 209/169 |
| 3,032,199 | 5/1962 | Sumiya | 209/170 |
| 3,050,188 | 8/1962 | Nisser | 209/169 |
| 3,322,684 | 5/1967 | Gibson | 209/170 |
| 3,339,730 | 9/1967 | Boutin | 209/170 |
| 3,455,451 | 7/1969 | Smith | 209/170 |
| 3,545,731 | 12/1970 | McManus | 261/122.1 |
| 3,642,617 | 2/1972 | Brink | 209/170 |
| 4,279,743 | 7/1981 | Miller | 209/170 |
| 4,301,973 | 11/1981 | Lai | 209/169 |
| 4,431,531 | 2/1984 | Hollingsworth | 209/170 |
| 4,448,681 | 5/1984 | Ludke | 209/170 |
| 4,478,766 | 10/1984 | Horikita | 209/170 |
| 4,592,834 | 6/1986 | Yang | 209/170 |
| 4,617,113 | 10/1986 | Christophersen et al. | 209/170 |
| 4,639,313 | 1/1987 | Zipperian | 209/170 |
| 4,668,382 | 5/1987 | Jameson | 209/164 |
| 4,735,709 | 4/1988 | Zipperian | 209/164 |
| 4,750,994 | 6/1988 | Schneider | 261/93 |
| 4,752,383 | 6/1988 | McKay | 209/170 |
| 4,838,434 | 6/1989 | Miller | 209/170 |
| 4,964,576 | 10/1990 | Datta | 241/19 |
| 4,971,731 | 11/1990 | Zipperian | 261/81 |
| 4,981,582 | 1/1991 | Yoon et al. | 209/164 |
| 5,039,400 | 8/1991 | Kallioinen | 261/87 |
| 5,049,320 | 9/1991 | Wang | 261/122.1 |
| 5,078,921 | 1/1992 | Zipperian | 261/122 |
| 5,096,572 | 3/1992 | Hwang | 209/169 |

FOREIGN PATENT DOCUMENTS

| | | | |
|---|---|---|---|
| 1053388 | 4/1979 | Canada | 209/170 |
| 0146235A2 | 6/1985 | European Pat. Off. . | |
| 211494 | 7/1984 | German Democratic Rep. . | |
| 457493 | 3/1975 | U.S.S.R. | 209/169 |
| 638380 | 12/1978 | U.S.S.R. | 209/169 |
| 1237256 | 6/1986 | U.S.S.R. . | |
| 460761 | 2/1937 | United Kingdom | 209/164 |
| 694918 | 7/1953 | United Kingdom . | |
| 2232097 | 12/1990 | United Kingdom | 209/169 |

OTHER PUBLICATIONS

XIV International Mineral Processing Congress Toronto, Canada Oct. 17-23, 1982 Sessions VII-VIII, Ludke et al.

*Primary Examiner*—Thomas M. Lithgow
*Attorney, Agent, or Firm*—Pennie & Edmonds

[57] ABSTRACT

A foam flotation reactor for the separation of hydrophobic and hydrophilic products is provided. The reactor combines a material to be beneficiated, collector reagents, and a stream of specifically generated gas bubbles, in order to collect the desired product in the foam in a more efficient manner. A narrowed upper part of the reactor and accompanying water sprays force separation of undesired particles. A foam generator efficiently supplies a bubbly liquid/frothing agent to the reactor.

12 Claims, 4 Drawing Sheets

FLOTATION REACTOR WITH EXTERNAL BUBBLE GENERATOR

This is a division of application Ser. No. 07/672,499, filed Mar. 20, 1991.

FIELD OF THE INVENTION

The present invention relates to a foam flotation reactor for the separation of two products: one hydrophobic and the other hydrophilic.

BACKGROUND OF THE INVENTION

Flotation processes have been developing over a period of more than 100 years, and various designs are in existence. One such system is the conventional mechanical cell employing an impeller located within a tank. A gas is introduced and dispersed through the impeller in order to generate bubbles to which the hydrophobic particles to be concentrated will adhere (see C. C. Harris, 1976). These mechanical cells continue to be the machines most widely used at the present time.

However, recent years have seen the introduction into the ore industry of machines generically known a "pneumatics," which had already been used in chemical processes and for waste water treatment (see Clarke & Wilson, 1983). In these machines the mixing of the gas and slurry takes place by means of injection nozzles. The most common of these devices are those known as columns and those of the Flotaire type (see K. V. S. Sastry, 1988). These have not yet been used in the ore industry on a large scale, however, due to difficulties in controlling their operation.

Finally, another type of machine has been developed recently, the length of which is shorter than that of columns. In these machines, the slurry is injected under pressure (see G. J. Jameson, 1988).

SUMMARY OF THE INVENTION

The present invention provides, in a flotation system, a reactor for separating hydrophobic material in a continuous and mechanically and energetically efficient manner. The reactor, which has a chamber that is preferentially but not necessarily of circular cross section, is used to bring together a slurry containing the material to be separated, a foam of controlled bubbles produced by a generator, and water for washing the foam. A controlled and efficient mixing of the slurry and foam in a turbulent manner in the lower part of the reactor chamber is effected, so that the foam is dispersed homogeneously over the entire cross section of the reactor, and enters into intimate contact with the particles that are desired to be extracted.

The slurry and foam are mixed in free ascent in the middle part of the reactor chamber, so that the desired particles have time to adhere to the controlled bubbles, and the undesired particles entrained by the movement of the fluid are able to detach themselves from the bubbles and then descend.

Separation of the particles of sterile material entrained with the rich foam of the desired material is effected in the upper part of the reactor chamber by means of a decrease in the cross section of the reactor which causes the rich foam to be compacted and its discharge velocity increased, and by a plane and controlled stream of water applied in the upper part of the foam.

Situated outside the above-mentioned reactor is a system for the generation of foam consisting of very fine and controlled bubbles. The generator contacts a stream of gas introduced at relatively low pressure and relatively high flow volume with a stream of liquid which preferentially, but not necessarily, contains the dissolved froth-producing reagent. An effective and intimate contact is produced between gas and the liquid/frothing agent mixture by means of a device made of a material of controlled porosity and having a relatively large area of contact, which permits a high bubble-generating capacity. The cost of the bubble-generating device is relatively low; it is easy to replace mechanically and comprises no movable mechanical parts.

DESCRIPTION OF THE PREFERRED EMBODIMENTS

Figure 1:
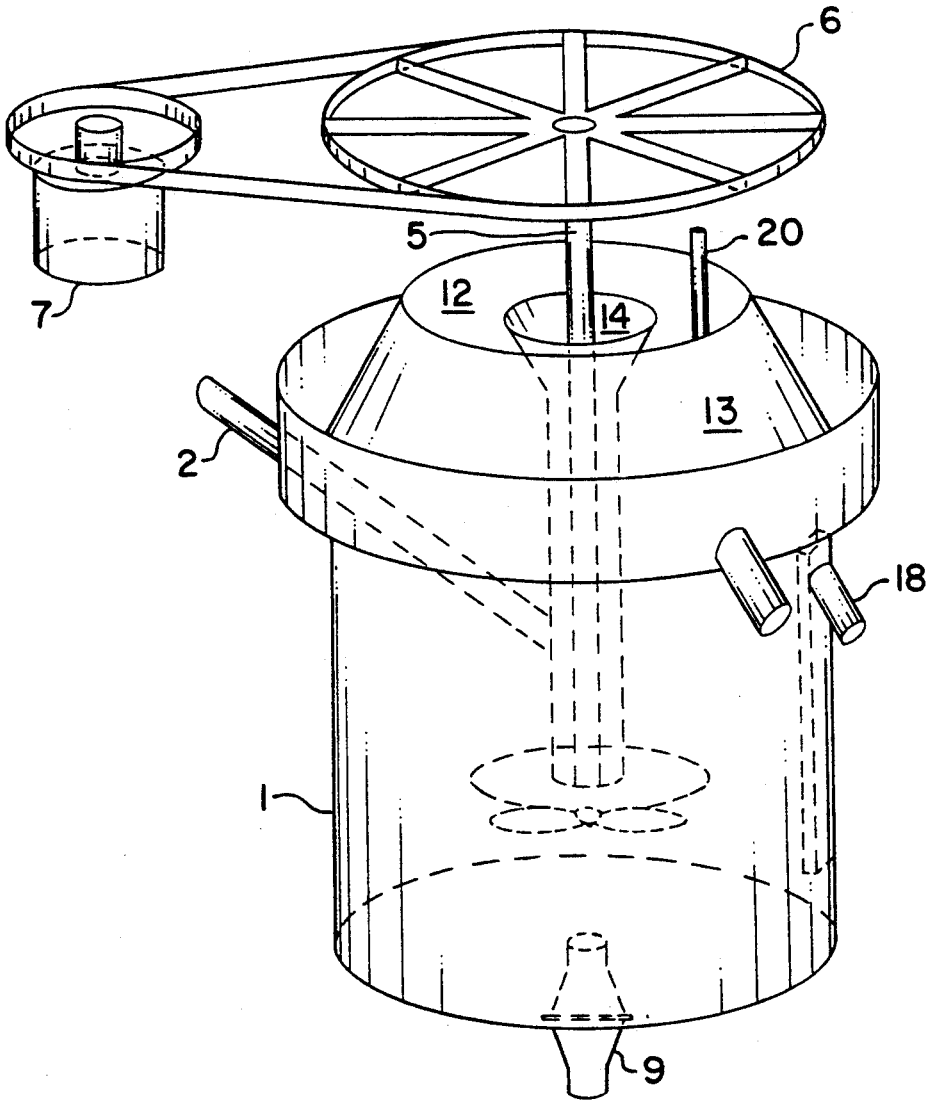
FIG. 1 is a perspective view of the flotation reactor of the present invention.
Figure 2:
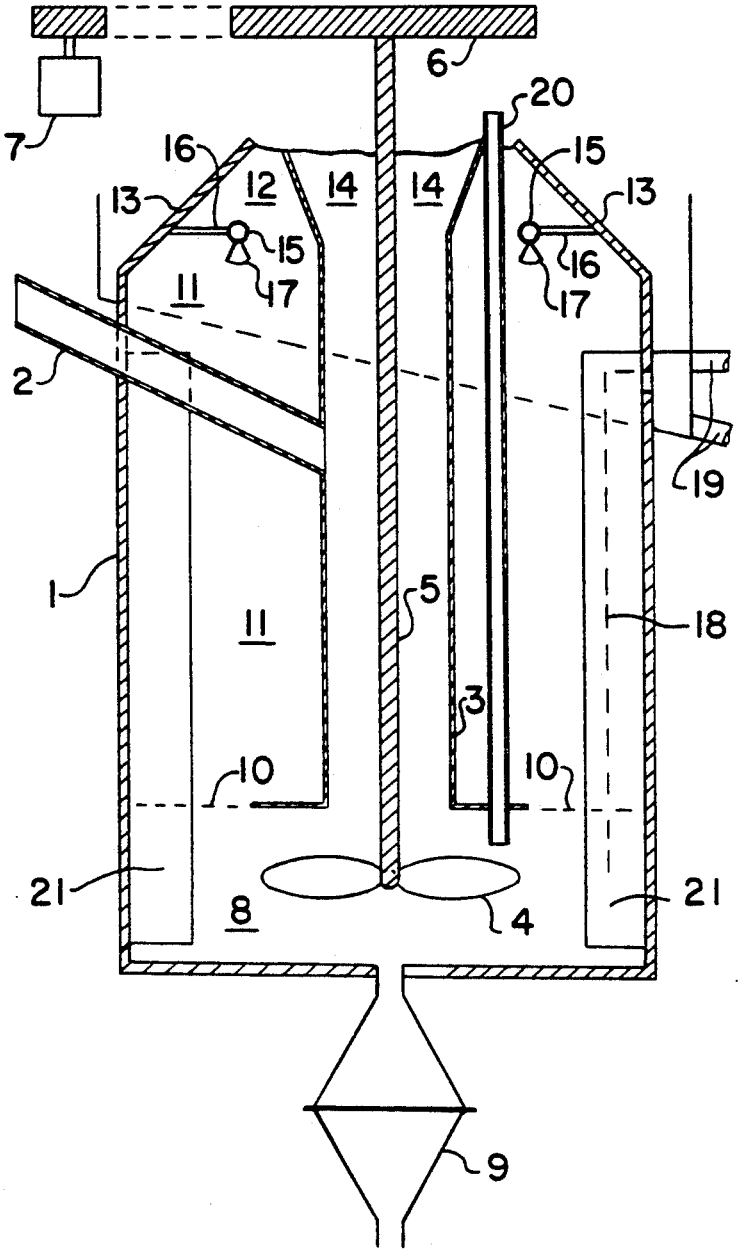
FIG. 2 is a vertical cross-section of the flotation reactor of FIG. 1 taken along its vertical axis.

FIGS. 1 and 2 show the reactor of the present invention which is used for the process of separation by flotation.

The slurry composed of an organic fluid such as water and the desired material to be recovered is fed by gravity or pump via a tube 2 into the reactor 1, which is preferably of circular cross section. Tube 2 is directed toward the axis of the reactor wherein a tube 3 (standpipe) is situated. Tube 3 is internally lined with an abrasion-resistant material, and carries the slurry to the impeller 4. The impeller is of the propeller type with a downward action; it is moved by a system consisting of the shaft 5, pulley 6 and motor 7, and generates considerable turbulence in the lower zone 8 of the reactor.

The slurry thus agitated meets a stream of small bubbles produced outside the reactor by the foam generator 9, which is described in greater detail below. The slurry enters into intimate contact with the stream of foam. The particles of desired material which are already hydrophobically activated on their surface preferentially adhere to the gas bubbles which they encounter.

The mix of slurry and bubbles rapidly ascends due to the currents generated by the agitation and the forces of flotation. The turbulence generated in the lower section is abated by a grid 10 arranged horizontally over the entire reactor cross section. Grid 10 is preferably of a strong material such as steel. The ascent of the bubbles enriched with the desired material continues at a slower rate in the middle zone 11, which permits undesired and mechanically entrained particles to be detached. This also creates a higher probability of contact with particles of the desired ore which had been ascendingly entrained by the flow lines and which may not have made contact with the bubbles.

The bubbles with the major part of the product to be separated form an upper foam zone 12 which is compacted, aided by the conical shape of the reactor 13 and of the upper part of the tube (standpipe) 14. The same conical shape in the upper part of the reactor aids in facilitating the discharge of the foam.

Immersed in the aforementioned foam zone 12 is a tube 15 fed with water and arranged in an annular fashion around the reactor and supported by a structure 16. From this tube, water is sprayed into the foam preferably by means of twelve sprays 17 of low flow rate, which washes the foam in order to detach the sterile or undesired material from the rich foam and increase the quality of the product.

The sterile or undesired material is transferred by gravity through a conduit 18 of preferably rectangular cross section arranged at one side of the reactor, preferably at 180° opposite the inlet of the slurry feedpipe 2. Conduit 18 has a system of variable discharge openings 19. The reactor also has a tube 20 extending from a level above the surface of the foam to a point preferably 100 mm above the bottom, which helps in impeding the settling of relatively large particles.

The body of the reactor contains four baffles 21 in a longitudinal position and disposed at 90° intervals along the cross section. These baffles prevent the formation of a vortex.

Figure 3:
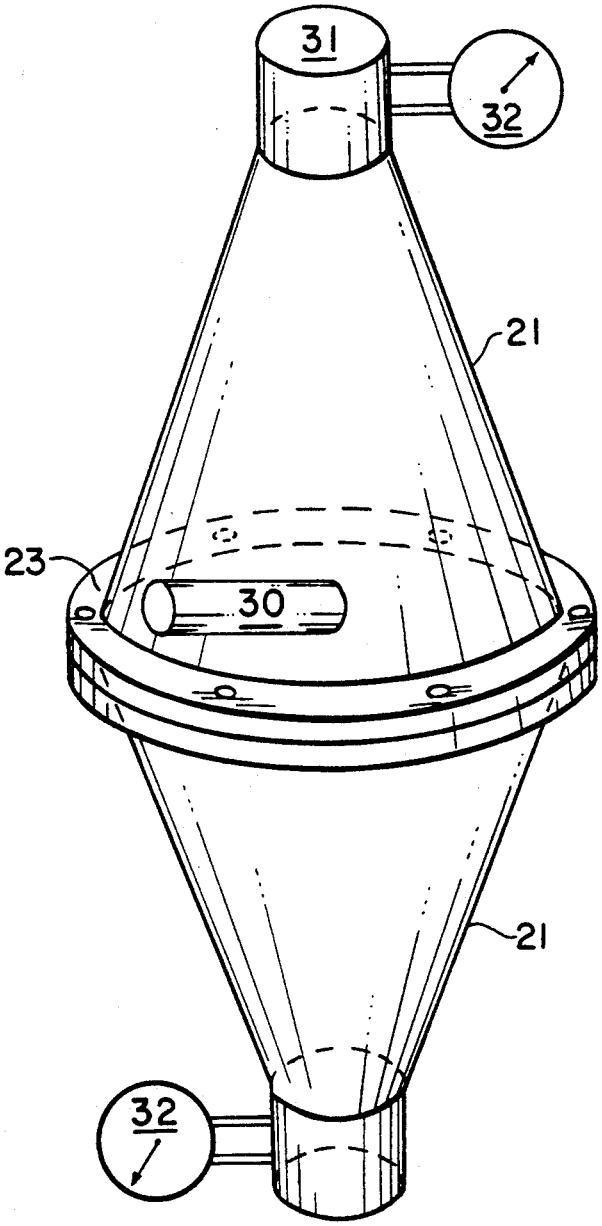
FIG. 3 is a perspective view of the foam-generating device of the present invention.
Figure 4:
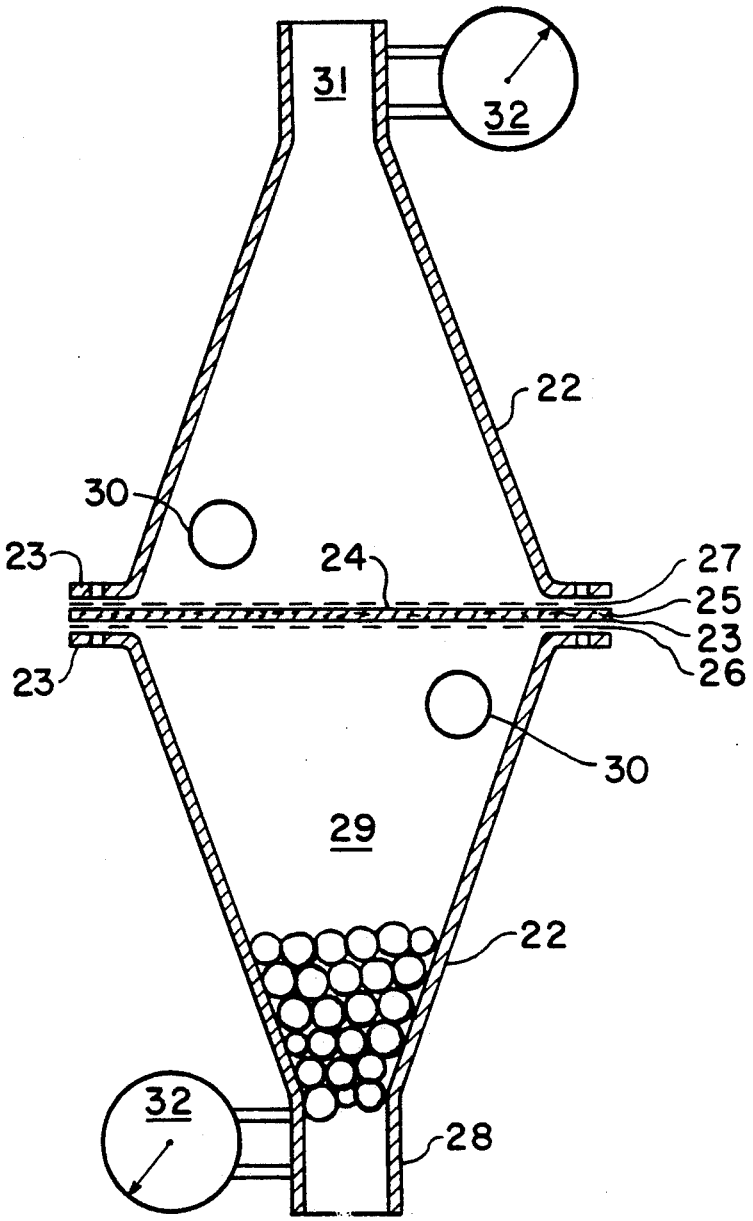
FIG. 4 is a vertical cross-section of the foam-generating device of FIG. 3, taken along its vertical axis.

A generator used for the creation of the stream of bubbles is shown in FIGS. 3 and 4. The generator 9 consists of two opposite conical parts 22 united by means of flanges 23. The ratio of height to maximum diameter of the cone should be between 1 and 2, and preferably 1.5. Arranged between the two parts is a generating element 24 having a controlled pore size. Generating element 24 preferably consists of a synthetic fiber 25, although it can also be a porous ceramic or metallic material. Element 24 is supported at its lower part by a strong metallic grid 26 preferably made of stainless steel, and is protected at its upper part by another metallic grid 27, also preferably made of stainless steel and with openings between 6 and 70 mesh, and preferably between 10 and 30 mesh.

The ratio between the greatest and smallest diameter of the conical parts is between 9 and 17, and preferably between 11 and 14.

To produce the bubbles, a gas at a relatively low pressure, i.e. between 1 and 4 kg/cm$^2$ and preferably between 1.5 and 2.5 kg/cm$^2$ is introduced by known means, such as diaphragm flow meters or orifice plates, through the lower inlet 28. This may be any industrially available gas, such as air, nitrogen, oxygen, carbon dioxide or argon. The gas passes through interspaces between objects arranged in the zone 29. These objects should be inert to oxidation and be preferably of spherical shape. In certain cases these objects may even be absent.

The gas passes through the generating element 24 and meets a stream of liquid previously mixed with the frothing agent or other reagents and which is tangentially fed via a tube 30. The liquid/frothing agent is typically introduced to the upper conical chamber at a height of between 10 and 60 mm above the porous element, and preferably between 25 and 35 mm above the porous element. The liquid flow is administered and measured by known means. The preferred ratio between gas and liquid/frothing agent should be between 3 and 7 per cent. Upon contact of the gas and the liquid/frothing agent mixture, bubbles of controlled size will be generated, said size depending essentially on the pore size and the flow volumes of gas and liquid/frothing agent, and on the quality and type of frothing agent. The flow of bubbles should typically be between 0.15 and 0.40 m$^3$/min per cubic meter of cell volume, and preferably between 0.20 and 0.30 m$^3$/min.

The bubbles formed leave through the orifice 31 and can be introduced directly into the above-described flotation reactor. Alternatively, the bubbles could be combined with the slurry to be treated, and the combined bubbles and slurry introduced to the reactor chamber. This could be accomplished by simply joining a tube carrying bubbles to the slurry tube ahead of the reactor slurry inlet, as would be readily understood by one skilled in the art.

To check the performance of the porous element, the inlet and outlet pressures are measured by manometers 32 arranged at both ends of the bubble generator.

In contrast to flotation in conventional mechanical subaeration cells in which the bubbles are generated internally by impellers and whose energy consumptions range between 8.46 and 157 kW/m$^3$h for small-size units and between 0.77 and 48.6 kW/m$^3$h for large-size units—the latter being larger than 100 m$^3$—the present reactor operates with bubbles generated externally and with an average energy consumption of 5.41 kW/m$^3$h for a cell of 4.6 m$^3$.

Moreover, in contrast to flotation in prior-art pneumatic columns, the height of the reactor of the present invention is considerably less than that of the aforementioned machines. As a result, the known problems of mechanical operation in controlling the height of the slurry and of the discharge of thick materials do not arise in this reactor, by virtue of the smaller load exerted by the slurry on the valves.

Furthermore, in contrast to the prior-art bubble generators used in ore flotation columns wherein a high air and/or water pressure is generally used, the generator forming part of the present invention uses gas at a relatively low pressure and a liquid/frothing agent at practically atmospheric pressure.

Also, unlike in the prior-art bubble generators for use in flotation columns in which the bubbles already formed are introduced into the column by means of dispensers immersed in the slurry, which are prone to problems with clogging, in the generator of the present invention the bubbles are introduced through the bottom of the reactor and directly toward the above-described impeller.

Finally, contrary to the relatively complex manufacture of the prior-art bubble generators for use in flotation columns, the generator of the present invention is simple to manufacture, and, above all, the porous element can be replaced with ease and at a relatively low cost.

Any of various desired materials can be collected by the present invention. For example, lead sulfide, zinc sulfide, copper sulfide, or a sulfide of any other base metal containing gold or silver can be collected. The desired material can be a non-metallic ore such as coal, kaolin, fluorite, barite, celestite, ilmenite, phosphorite or magnesite. The desired material could also be a metal cation or anion, such as cyanide, phosphate, arsenite, molybdate or fluoride, any of which might typically be contained in solutions. Ink or kaolin contained in paper pulp are also possible desired materials for collection by the present invention. A further desired material might be a colloid or surfactant used in the treatment of waste water, or any other organic agent to be separated from a solution. These examples are intended to be illustrative, and not exhaustive, of the materials that can be collected by the present invention.

We claim:

1. A generator for creating a foam having bubbles, comprising:

a generator chamber having an upper portion and a lower portion, wherein the upper and lower portions of the generator chamber comprise upper and lower conical chambers each having a wide and a narrow end;

means for introducing a measured flow of gas to the lower portion of the generator chamber, said means for introducing a flow of gas comprising a gas inlet at the narrow end of the lower conical chamber, said upper conical chamber having a foam outlet at its narrow end;

a porous element disposed within the generator chamber intermediate said upper and lower portions and through which the gas flows, the upper and lower conical chambers being joined across their wide ends with the porous element between the upper and lower conical chambers; and means for introducing a flow of liquid/frothing agent into the upper portion of the generator chamber above said porous element, whereby, upon contact of the gas and liquid/frothing agent, a stream of foam comprising controlled fine bubbles is produced, and wherein the flow of liquid/frothing agent is introduced tangentially to the axis of the upper conical chamber at a height of between 10 and 60 mm above the porous element.

2. The operator of claim 1, further comprising diaphragm manometers located at the narrow ends of the upper and lower generator chambers, for measuring the gas pressure at the inlet of the lower chamber and the foam pressure at the outlet of the upper chamber.

3. A generator for creating a foam having bubbles, comprising:

a generator chamber having an upper portion and a lower portion, wherein the upper and lower portions of the generator chamber comprise upper and lower conical chambers each having a wide end and a narrow end;

means for introducing a measured flow of gas to the lower portion of the generator chamber, said means for introducing a flow of gas comprising a gas inlet at the narrow end of the lower conical chamber, said upper conical chamber having a foam outlet at its narrow end;

a porous element disposed within the generator chamber intermediate said upper and lower portions and through which the gas flows, the upper and lower conical chambers being joined across their wide ends with the porous element between the upper and lower conical chambers; and means for introducing a flow of liquid/frothing agent into the upper portion of the generator chamber above said porous element, whereby, upon contact of the gas and liquid/frothing agent, a stream of foam comprising controlled fine bubbles is produced, wherein the flow of liquid/frothing agent is introduced tangentially to the axis of the upper conical chamber.

4. A generator for creating a foam having bubbles, comprising:

a generator chamber having an upper portion and a lower portion;

means for introducing a measured flow of gas to the lower portion of the generator chamber;

a porous element extending across the generator chamber intermediate said upper and lower portions and defining said upper portion above the porous element and the lower portion below the porous element and through which the gas flows from the lower portion to the upper portion;

means for introducing a flow of liquid/frothing agent tangentially into the upper portion of the generator chamber above said porous element, whereby, upon contact of the gas and liquid/frothing agent, a stream of foam comprising controlled fine bubbles is produced; and a bed of objects disposed within the generator chamber below the porous element and past which the gas must flow before contacting the porous element.

5. The generator of claim 4, wherein the objects are spherical.

6. The generator of claim 4, wherein the porous element is composed of a synthetic plastic material and has a pore size of between 0.5 and 5 $\mu$.

7. The generator of claim 4, wherein the porous element is composed of a ceramic material and has a pore size of between 0.5 and 5 $\mu$.

8. The generator of claim 4, wherein the porous element is composed of compressed and porous metal and has a pore size of between 0.5 and 5 $\mu$.

9. The generator of claim 4, wherein the porous element is protected and supported at a lower surface thereof by a substantially rigid grid.

10. The generator of claim 9, wherein the porous element protecting grid is stainless steel and has openings of between 6 and 70 mesh.

11. The generator of claim 4, wherein said upper and lower portions of said generator chamber are symmetrical about a horizontal plane therebetween.

12. The generator of claim 4, wherein said porous element bisects said upper and lower portions of said generator chamber.

* * * * *